US006287190B1

(12) United States Patent
Inoue et al.

(10) Patent No.: US 6,287,190 B1
(45) Date of Patent: Sep. 11, 2001

(54) HAND-HELD EPILATING DEVICE

(75) Inventors: Tomoyuki Inoue, Hikone; Hidekazu Sueyoshi, Shiga; Jyuzaemon Iwasaki, Nagahama, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/625,724

(22) Filed: Jul. 26, 2000

(30) Foreign Application Priority Data

Jul. 27, 1999 (JP) ..... 11-212863
Mar. 28, 2000 (JP) ..... 12-087733

(51) Int. Cl.[7] ..... A22B 5/08
(52) U.S. Cl. ..... 452/82; 452/83; 606/133
(58) Field of Search ..... 452/82, 84, 83, 452/85, 71; 606/133

(56) References Cited

U.S. PATENT DOCUMENTS 4,960,422 * 10/1990 Demeester ..... 452/83
5,032,126 * 7/1991 Cleyet et al. ..... 606/133
5,196,021 * 3/1993 Kabla ..... 452/83
5,197,969 * 3/1993 Visscher et al. ..... 452/82
5,207,689 * 5/1993 Demeester ..... 452/84
5,857,903 1/1999 Ramspeck et al. .

FOREIGN PATENT DOCUMENTS

0532106A1 3/1993 (EP) .

* cited by examiner

*Primary Examiner*—Willis Little
(74) *Attorney, Agent, or Firm*—Arent Fox Kintner Plotkin & Kahn, PLLC

(57) ABSTRACT

A hand-held epilating device capable of increasing plucking efficiency. The epilating device has a housing to be grasped by a hand of a user, and a plucking cylinder carrying at least one set of pinching elements for catching and pinching body hairs therebetween. The plucking cylinder has a longitudinal axis and is driven to rotate about the longitudinal axis to pluck the body hairs from the user's skin. The plucking cylinder is supported to the housing so as to effect a periodical movement relative to the housing within a plane parallel to the longitudinal axis. Thus, the area of the skin covered by the plucking cylinder can have increased chances of being in contact with the pinching elements as the pinching elements move periodically relative to the skin together with the plucking cylinder, thereby improving the plucking efficiency.

22 Claims, 17 Drawing Sheets

38
45
51
53
52
71
72
61
43
46
50
60
37
42
55
22
43
46
51
50
47
53
52
56
41
55
37
91
92
33
36
35
32
35
21
31
36

HAND-HELD EPILATING DEVICE

BACKGROUND OF THE INVENTION

1. Field of the Invention

The present invention is directed to a hand-held epilating device, more particularly to such a device having a plucking cylinder which is driven to rotate for plucking body hairs.

2. Description of the Prior Art

U.S. Pat. No. 5,857,903 discloses a hand-held epilating device having a rotary cylinder which is provided with sets of pinching elements for pinching body hairs therebetween. The rotary cylinder is driven to rotate about its longitudinal axis to pluck the pinched hairs. The rotary cylinder is supported to a head member fixed to a housing grasped by the hand of a user so that the pinching elements on the rotary cylinder traces only a circular path around the rotary cylinder and do not move in the other directions relative to a skin surface of the user when the rotary cylinder is held against a fixed area of the skin surface. Since the sets of the pinching elements are arranged in a spaced relation from each other on the rotary cylinder, the hairs at the portions corresponding to gaps between the adjacent sets of the pinching elements have no chances of being plucked. That is, the hair plucking is made to limited portions within the area of the skin covered by the rotary cylinder, posing insufficient plucking efficiency.

SUMMARY OF THE INVENTION

In view of the above insufficiency, the present invention has been accomplished to provide a hand-held epilating device which is capable of increasing plucking efficiency. The epilating device in accordance with the present invention comprises a housing to be grasped by a hand of a user, and a plucking cylinder carrying at least one set of pinching elements for catching and pinching body hairs therebetween. The plucking cylinder has a longitudinal axis and is driven to rotate about the longitudinal axis to pluck the body hairs from the user's skin. The plucking cylinder is supported to the housing so as to effect a periodical movement relative to the housing within a plane parallel to the longitudinal axis. Thus, the area of the skin covered by the plucking cylinder can have increased chances of being in contact with the pinching elements as the pinching elements move periodically relative to the skin together with the plucking cylinder, thereby improving the plucking efficiency.

Preferably, the plucking cylinder is arranged to reciprocate relative to the housing along the longitudinal axis so that the pinching elements on the plucking cylinder move along the longitudinal axis to cover a wide area of the skin along the length of the plucking cylinder.

In a preferred version, the plucking cylinder reciprocates relative to the housing between two end positions and is held temporarily at each of the end positions for a short time interval during which the plucking cylinder rotates to such an extent of completing one epilating action of catching the body hairs between the pinching elements and plucking the body hairs. Thus, the hair plucking is made both at the two axially spaced end positions with the same set of the pinching elements.

Further, the plucking cylinder has a neutral position between the two end positions and is held temporarily at the neutral position for a short time during which the plucking cylinder rotates about the longitudinal axis to such an extent of completing one epilating action of catching the body hairs between the pinching elements and plucking the body hairs.

With this result, each set of the pinching elements can make the hair plucking at three axially spaced positions, namely, the neutral position and the two end positions, for increasing the plucking efficiency.

The plucking cylinder is preferred to carry at least two sets of the pinching elements which are spaced along the longitudinal axis at a pitch distance between the adjacent set of the pinching elements. In this connection, the plucking cylinder is caused to reciprocate at an amplitude which is ⅓ to ½ of the pitch distance so that the each set of the pinching elements covers a wide area of the skin without causing overlapping of the areas covered respectively by adjacent sets of the pinching elements.

Preferably, the plucking cylinder is driven to move between the neutral position and each of the end positions at a speed which is greater than a circumferential speed of the plucking cylinder. Thus, the plucking cylinder moves rapidly between the neutral position and each of the end positions for making the hair plucking at the three axial positions and minimizing a chance of the hair being plucked during the transition period of the plucking cylinder moving between the neutral and the end position where the hair would be pulled in a direction rather than the circumferential direction and would be plucked with a pain or even fail to be plucked.

The plucking cylinder may be spring-biased towards the neutral position for smoothly moves the plucking cylinder back and forth in the axial direction while reducing inertia force towards the end positions.

The plucking cylinder is preferred to reciprocate along the longitudinal axis at a reciprocation cycle which is greater than a rotating cycle at which the plucking cylinder completes one rotation about the longitudinal axis. Thus, it is possible to give an increased number of rotation of the plucking cylinder while plucking cylinder reciprocates along the longitudinal axis, thereby increasing the chances of pinching the hairs at the different axial positions for enhancing the plucking efficiency. Preferably, the reciprocation cycle is at least twice of the rotation cycle.

The plucking cylinder is preferred to have more than one set of the pinching elements spaced circumferentially about the longitudinal axis so as to increase the chance of plucking the hair per one rotation of the plucking cylinder.

Mounted on the housing is a head frame having a top opening through which the pinching elements are exposed for catching the body hairs. The head frame is movably supported to the housing and is coupled to the plucking cylinder so that the head frame makes the periodical movement together with the plucking cylinder. Alternately, the head frame may be fixed to the housing so that the plucking cylinder makes the periodical movement relative to the head frame. In this instance, the head fame is held stationary while the plucking cylinder reciprocates, thereby giving no rubbing action to the skin with which the head frame is in contact.

In another version, the plucking cylinder reciprocates along a direction which is perpendicular to the longitudinal axis. Thus, the set of the pinching elements can move back and forth along the tangential direction of the plucking cylinder to increase the chances of plucking the hairs lying along the tangential direction of the plucking cylinder.

In this version, the pinching elements are arranged along the longitudinal axis of the plucking cylinder and have a length along a circumferential of the plucking cylinder. The plucking cylinder is preferred to reciprocate at an amplitude which is substantially equal to the length of the pinching element, thereby doubling the effective length of the pinching elements responsible for pinching the hairs therebetween for increasing the hair plucking efficiency.

Further, the plucking cylinder reciprocates along the direction perpendicular to the longitudinal axis between opposite end positions and is held temporarily at each of the end positions for a short time interval during which the plucking cylinder rotates to such an extent of completing one epilating action of catching the hairs between the pinching elements and plucking the hairs. Thus, the hair plucking can be made at two different end positions for increasing the hair plucking efficiency.

Also, the plucking cylinder has a neutral position between the opposite end positions and is held temporarily at the neutral position for a short time interval during which the plucking cylinder rotates to such an extent of completing one epilating action of catching the hairs between the pinching elements and plucking the hairs. The plucking cylinder moves between the neutral position and the end positions at a speed greater than the circumferential speed of the plucking cylinder. Therefore, the hair plucking can be made at three different positions, while it is possible to minimize a transition period for movement between the neutral position to the end positions for further enhancing the plucking efficiency.

The plucking cylinder is preferred to reciprocate at a reciprocation cycle which is greater than a rotating cycle at which the plucking cylinder completes one rotation. Thus, it is possible to give an increased number of rotation of the plucking cylinder while plucking cylinder reciprocates along the direction perpendicular to the longitudinal axis, thereby increasing the chances of pinching the hairs at the different positions for enhancing the plucking efficiency. Preferably, the reciprocation cycle is at least twice of the rotation cycle.

Further, the plucking cylinder may be arranged to reciprocate along the longitudinal axis as well as along the direction perpendicular to the longitudinal axis so as to effect a translational movement relative to the housing, thereby enabling the hair plucking at the different positions both along the longitudinal axis and along the direction perpendicular thereto, further increasing the hair plucking efficiency.

In the meanwhile, the present invention discloses an advantageous feature which may be carried out independently of the above described features. The advantageous feature is associated with a structure in which the plucking cylinder carries plural sets of the pinching elements spaced circumferentially about the longitudinal axis. Each set of the pinching elements includes a movable element which is driven to move along the longitudinal axis for pinching the hairs between the pinching elements. Also carried by the plucking cylinder are a plurality of actuator bars which extend in parallel to the longitudinal axis and are arranged circumferentially about the longitudinal axis. Each actuator bar has a first end engaged with the movable element for driving the same, and has a second end projecting on one end face of the plucking cylinder to be engageable with a cam disposed to oppose the end face. The cam is positioned be in selective contact with the second ends of the actuator bars in such a manner as to move the actuator bars in a direction of pinching the hairs between the pinching elements as the plucking cylinder rotates about the longitudinal axis. The second end of each actuator bar is shaped to extend circumferentially about the longitudinal axis on the end face of the plucking cylinder to define an arcuate flange. The arcuate flanges of the circumferentially adjacent actuator bars are partially overlapped with each other in a radial direction such that the overlapped portions of the arcuate flanges come simultaneously into contact with the cam. With this arrangement, the arcuate flanges of the individual actuator bars come into contact with the cam to keep pinching the hairs between the pinching elements over a prolonged period within which the plucking cylinder rotates to pluck the hair successfully. Therefore, it is possible to arrange an increased number of the sets of the pinching blades circumferentially on the plucking cylinder of limited diameter, yet assuring to make the hair plucking successfully.

Preferably, the arcuate flanges of the actuator bars are arranged in two circumferential rows extending about the longitudinal axis, one being an outer circumferential row and the other being an inner circumferential row. The arcuate flanges of the outer circumferential row are staggered circumferentially with respect to the arcuate flanges of the inner circumferential row. In this arrangement, it is preferred that each arcuate flange of the outer circumferential row is overlapped with the two adjacent arcuate flanges of the inner circumferential row over about one-half circumferential length of the arcuate flange of the outer circumferential row.

These and still other objects and advantageous features of the present invention will become more apparent from the following description of the preferred embodiments and the modifications thereof when taken in conjunction with the attached drawings.

DETAILED DESCRIPTION OF THE EMBODIMENTS

Figure 1:
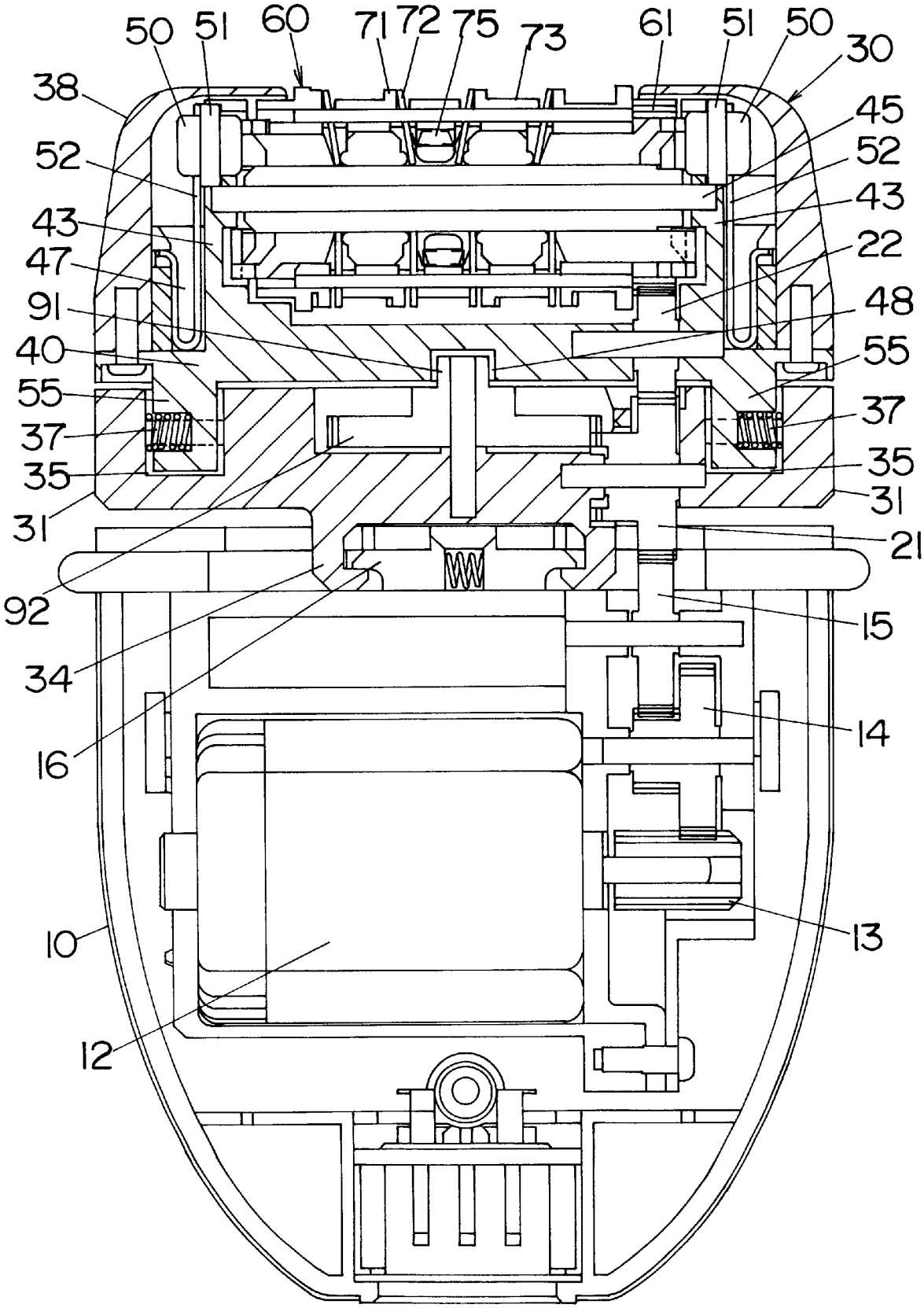
FIG. 1 is a vertical section of a hand-held epilating device in accordance with a first embodiment of the present invention.
Figure 2:
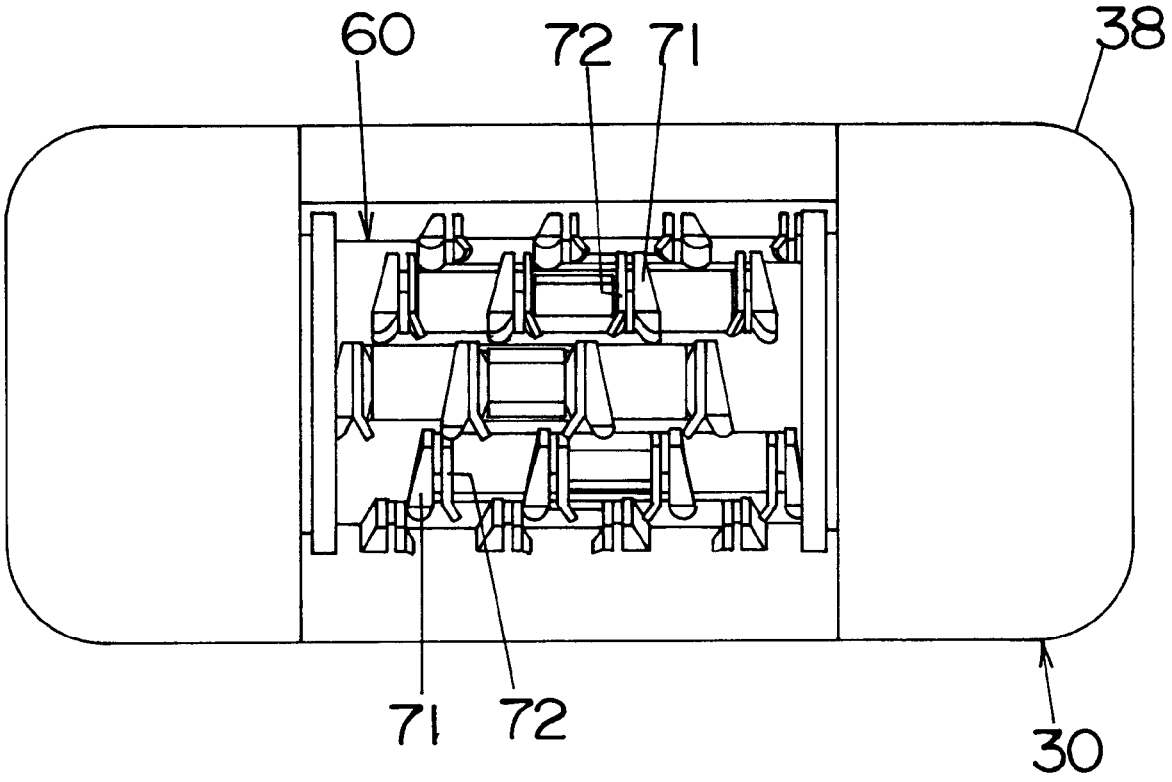
FIG. 2 is a top view of the epilating device.
Figure 3:
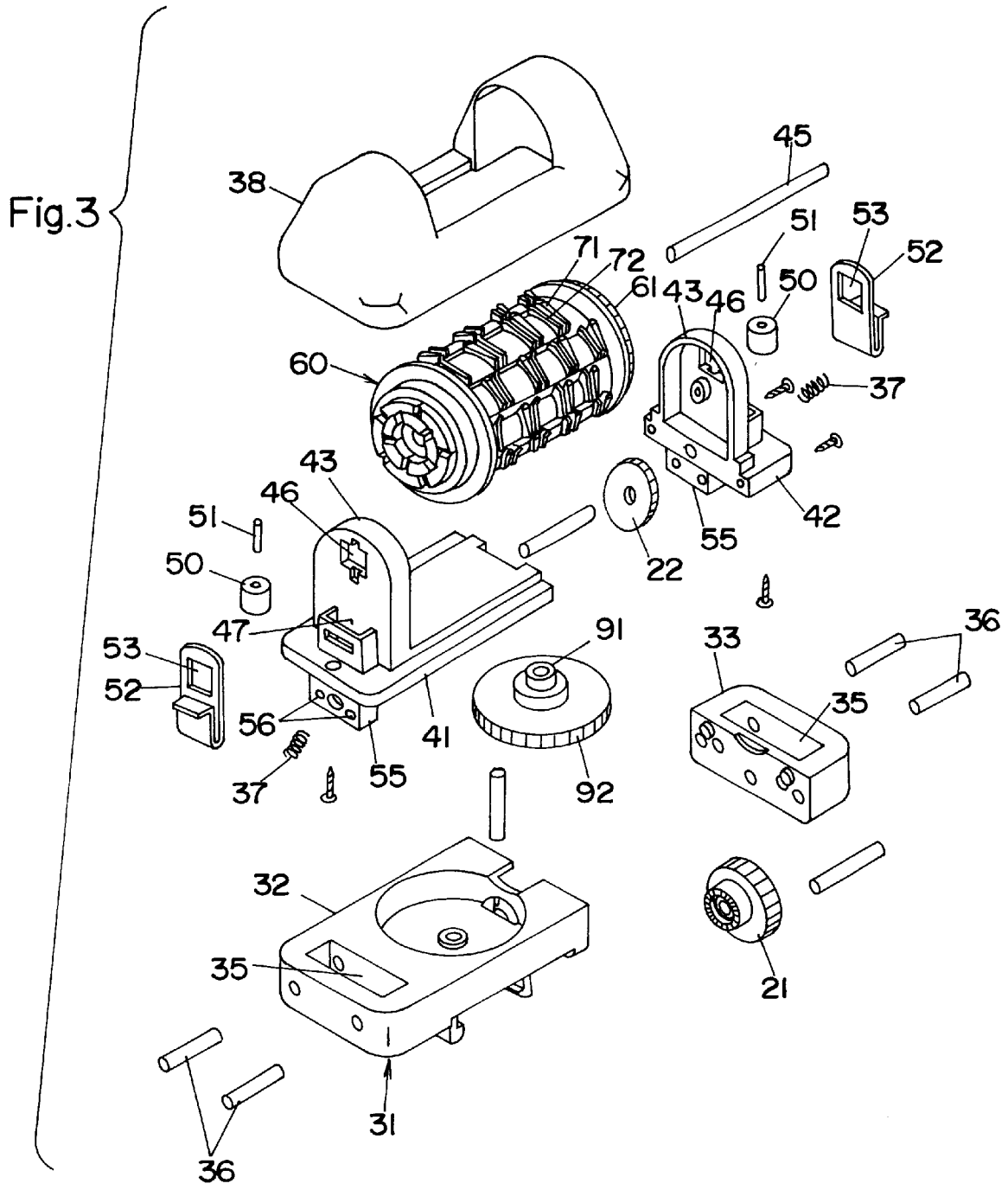
FIG. 3 is an exploded perspective view of a principal portion of the epilator device.

Referring now to FIGS. 1 to 3, there is shown a hand-held epilating device in accordance with a first embodiment of the present invention. The epilating device has a housing 10 to be grasped by a user's hand and an epilator head 30 detachably mounted on top of the housing 10. The housing 10 has an upright axis and accommodates an electric motor 12 and a set of driving gears 13 to 15 for providing a source of operating the epilator head 30. The epilator head 30 is composed of a base 31, a head frame 40, a head cover 38 and a plucking cylinder 60. The base 31 is provided on its bottom with hooks 34 for detachable engagement with latches 16 on top of the housing 10. The head frame 40 is supported on the base 31 and carries the plucking cylinder 60 as well as the head cover 38. As best shown in FIG. 3, the base 31 is of two-parts structure having a main base 32 and a sub base 33 which are assembled together with a first driven gear 21 interposed therebetween. The first driven gear 21 comes into meshing engagement with the driving gear 15 when the epilator head 30 is attached to the housing 10. The head frame 40 is also of two-parts structure having a main frame 41 and a sub frame 42 which are assembled together with a second driven gear 22 interposed therebetween. The head frame 40 is formed at its longitudinal ends respectively with end walls 43 between which a center pin 45 extends for rotatably supporting the plucking cylinder 60 thereabout. The plucking cylinder 60 is formed at its one longitudinal end with a gear 61 which meshes with the first driven gear through the second gear 22 so that the plucking cylinder 60 is driven to rotate about a longitudinal axis defined by the center pin 45. The head cover 38 is supported to the head frame 40 and has a top opening through which a portion of the plucking cylinder 60 is exposed for contact with the user's skin.

Figure 4:
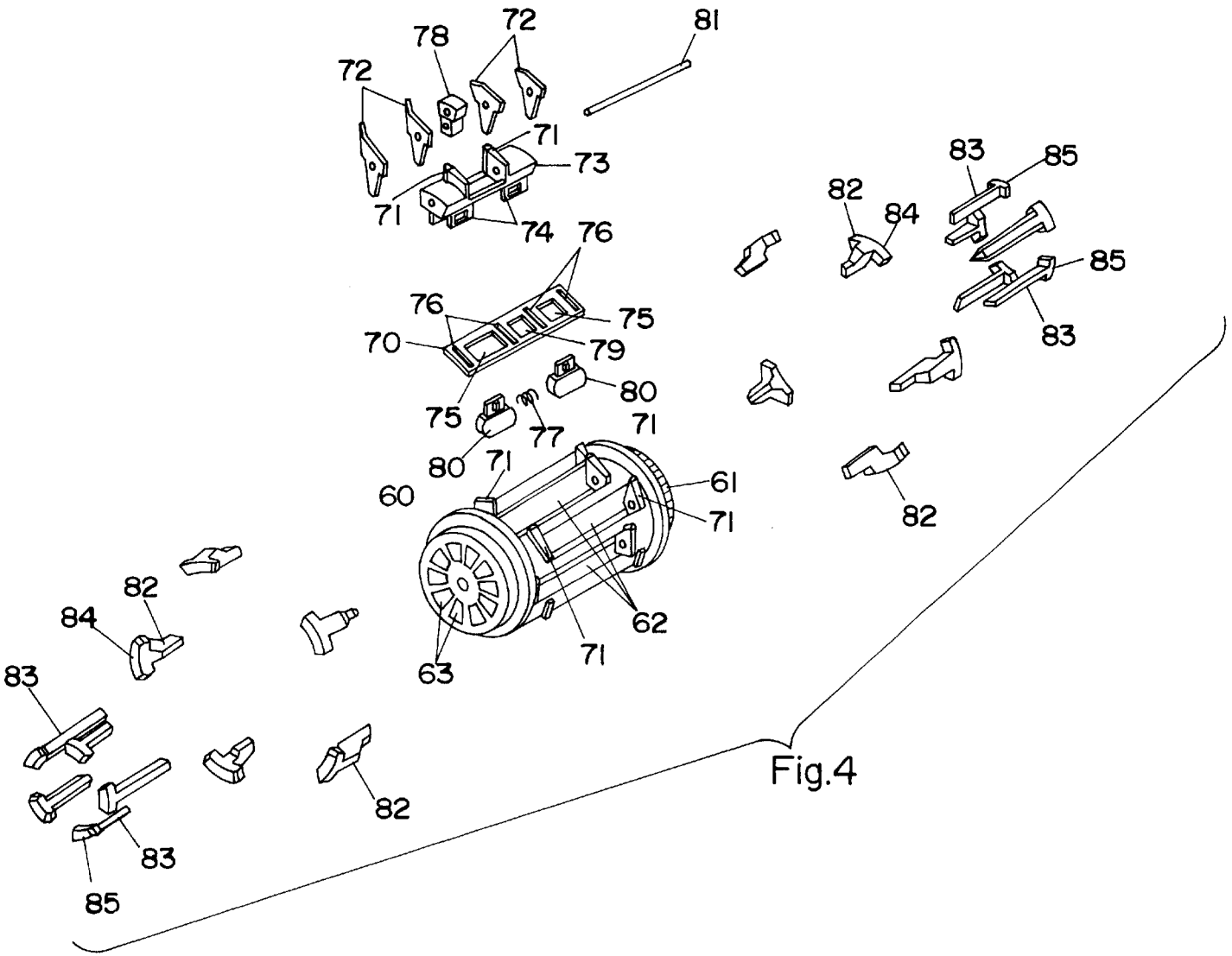
FIG. 4 is an exploded perspective view of a plucking cylinder employed in the epilating device.
Figure 5:
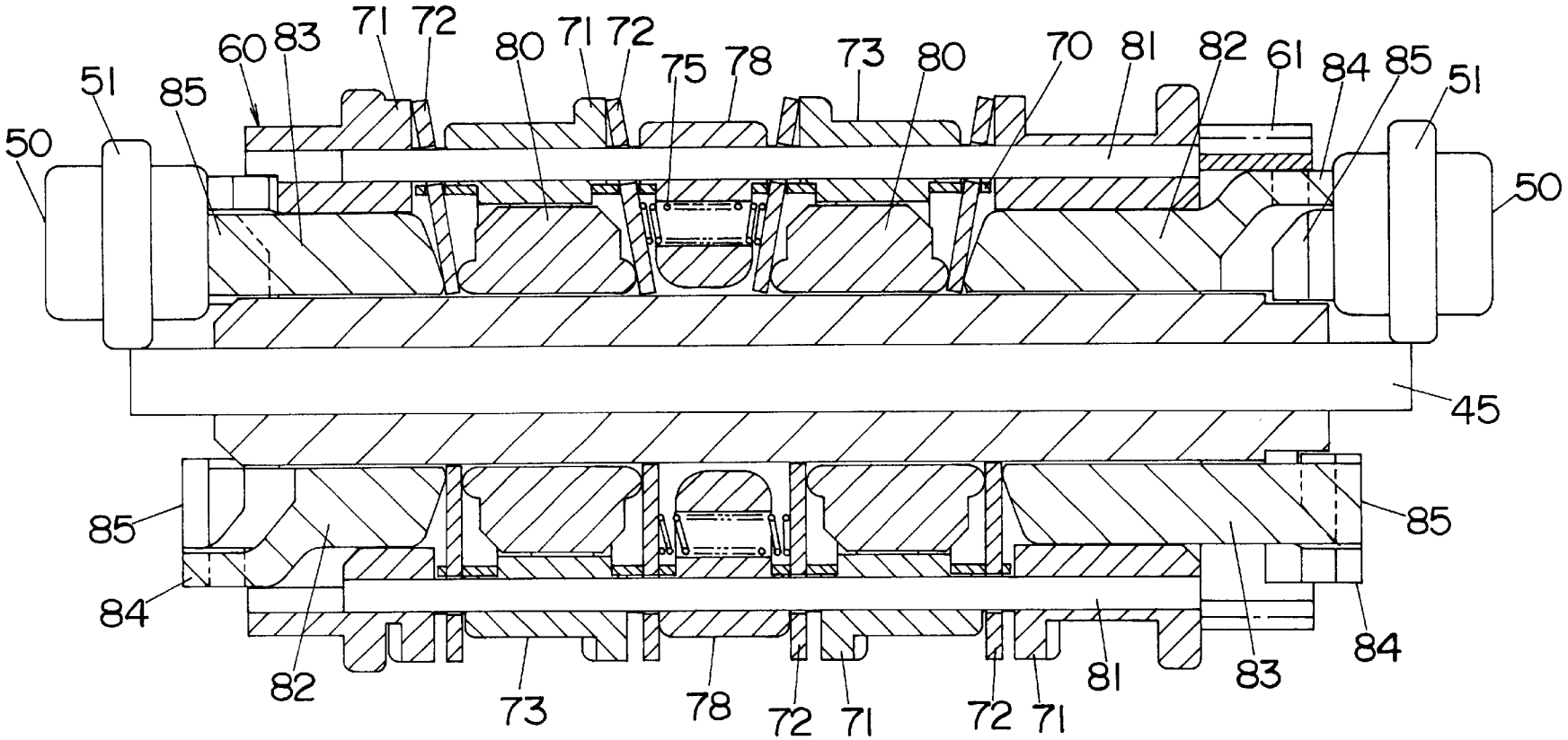
FIG. 5 is a vertical section of the plucking cylinder shown with associated cams.

As shown in FIGS. 2 and 3, the plucking cylinder 60 carries a plurality of rows of pinching elements 71 and 72 arranged uniformly around the circumference of the cylinder. Each row consists of plural sets of the pinching elements 71 and 72 spaced axially or longitudinally at a uniform pitch distance. As best shown in FIGS. 4 and 5, the pinching elements and in each set are defined respectively by a fixed blade 71 and a movable blade 72. The movable blades 72 are caused to pivot about an axis perpendicular to the longitudinal axis of the plucking cylinder 60 to open and close the gap between the adjacent blades 71 and 72 as the plucking cylinder 60 rotates about the longitudinal axis, thereby catching and pinching the hairs between the blades. The closure of the blades 71 and 72 are kept over a certain angular displacement of the blades 71 and 72 around the longitudinal axis, i.e., a fraction of one rotation of the plucking cylinder 60, thereby pulling the hairs pinched between the blades 71 and 72 in a tangential direction of the plucking cylinder 60 for plucking the hairs.

As shown in FIG. 4, the fixed blades 71 are formed on a block 73 as well as on the plucking cylinder 60 itself. The fixed blades 71 on the block 73 and the movable blades 72 are supported to a retainer 70 in the form of a plate. The retainer 70 is formed with a pair of end holes 75 for receiving legs 74 of the block 73, and is further formed with a plurality of longitudinally spaced slots 76 respectively for receiving the movable blades 72. A slider 80, which is slidably supported to the legs 74 of the block 73, is disposed between each adjacent pair of the movable blade 72 for interconnection of the blades. As best shown in FIG. 5, a coil spring 77 is compressed between two adjacent center blades 72 to urge all of the movable blades 72 away from the associated fixed blades 71 in a direction of opening the gaps between the blades. The coil spring 77 is held by a holder 78 engaged in a center hole 79 of the retainer 70. A pin 81 extends through the fixed blade 71, the movable blades 72, and the holder 78 to align these parts longitudinally. Further, the movable blades 72, the block 73 with the fixed blades 71, the holder 78, and the sliders 80 are assembled together on the retainer 70 to constitute a self-contained single unit which is placed into each one of longitudinally extending recesses 62 formed in the periphery of the plucking cylinder 60 and is held therein by engaging the opposite ends of the pin 81 into corresponding holes in the fixed blades 71 formed at the opposite longitudinal ends of the recess 62.

The recesses 62 are opened to opposite end faces of the plucking cylinder 60 to define thereat end opening 63 which are circumferentially arranged about the longitudinal axis. Fitted into the each recess 62 through the opposite end openings 63 are a pair of acutator bars 82 and 83 which abut at their inner ends respectively against the outer movable blades 72 in each row of the blades, as shown in FIG. 5. The outer ends of the actuator bars 82 and 83 come into contact respectively with cam rollers 50 at the opposite ends of the head frame 40 as the plucking cylinder 60 rotates. Whereby, the actuator bars 82 and 83 are pressed by the cam rollers 50 to push the lower ends of the movable blades 72 axially inwardly. With this result, each movable blade 72 pivots about a pivot axis to close the gap between the blades for pinching the hairs, as shown in the upper half of FIG. 5. The pivot axis is defined at the interface between the blade 72 and the edge of the slot 76 in the retainer 70 to extend perpendicular to the longitudinal axis of the plucking cylinder. As the plucking cylinder 60 further rotates, the actuator bars 82 and 83 come out of contact with the cam rollers 50 to be therefore released therefrom and are caused to open the blade 71 and 72 by the action of the coil spring 77, as shown in the lower half of FIG. 5.

As shown in FIGS. 1 and 3, the cam rollers 50 are mounted respectively in holes 46 of the end walls 43 of the head frame 40 and are rotatable about individual pins 51. Each cam roller 50 is pressed inwardly against the outer end of the actuator bar 82, 83 by a spring plate 52 secured to the end wall 73 and the retainer 70. The spring plate 52 is formed in its upper end with an opening 53 of which edges are engaged with the pin 51 extending through the cam roller 50 to bias the cam roller 50 towards the corresponding end of the actuator bars 82 and 83. The spring plate 52 is held in place with its lower end inserted in a socket 47 of the end wall 43 of the retainer 40.

Figure 6:
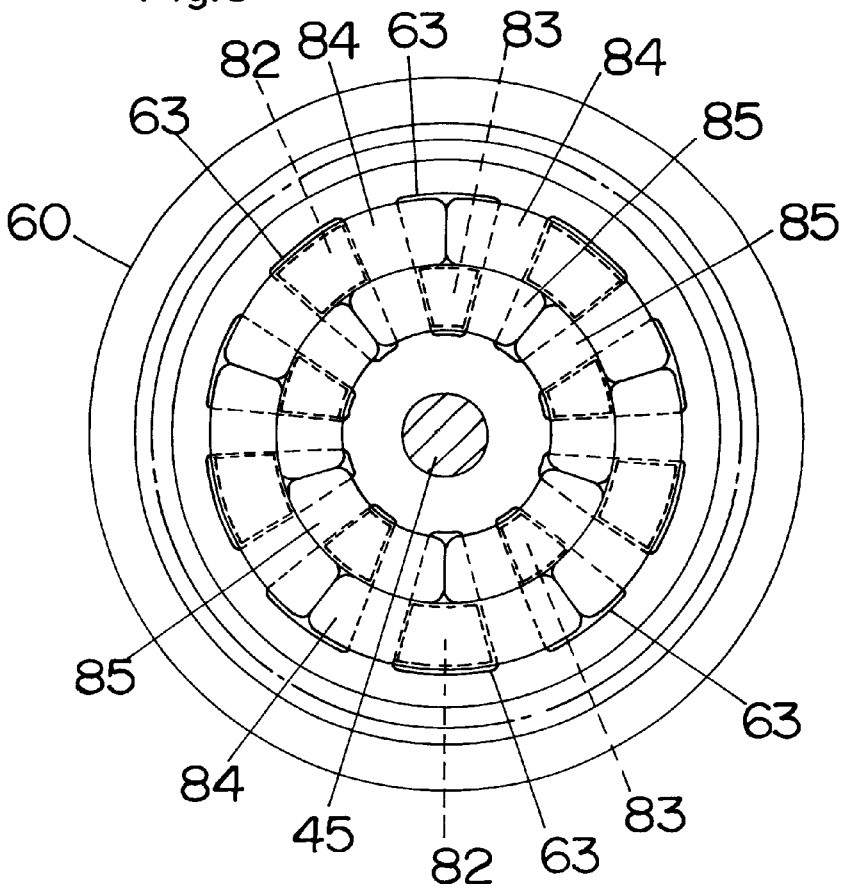
FIG. 6 is a side view of the plucking cylinder.
Figure 7:
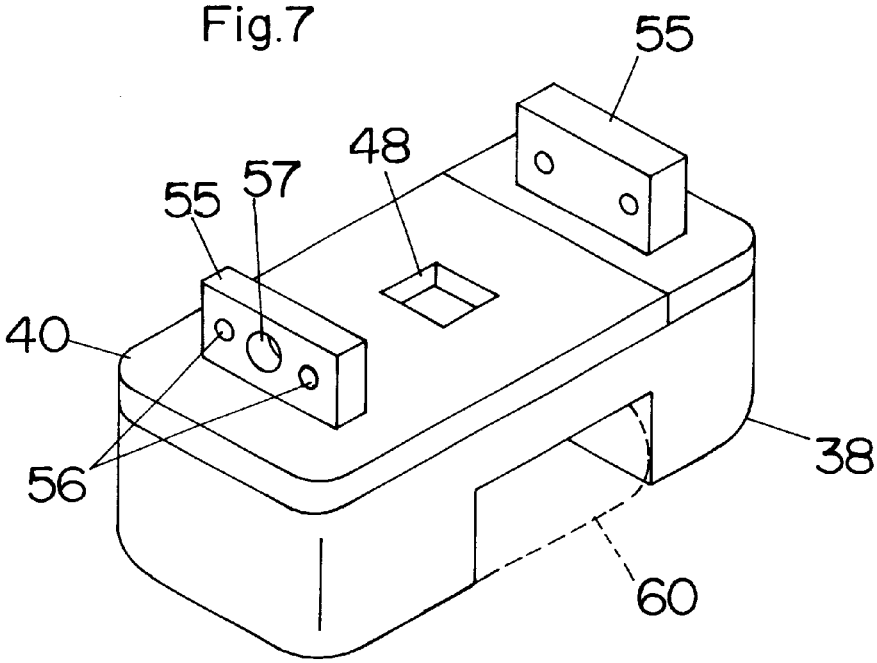
FIG. 7 is a perspective view illustrating the bottom of the plucking cylinder.

As shown in FIGS. 4 and 6, the actuator bars 82 and 83 are each formed at its outer end with an arcuate flange 84 and 85 which extends circumferentially about the longitudinal axis of the plucking cylinder 60 for pressed contact with the corresponding cam roller 50 over a prolonged period as the plucking cylinder 60 rotates. As best shown in FIG. 4, the actuator bars 82 and 83 consist of two types having different configurations, a first type having the arcuate flange 84 offset radially outwardly relative to a shank of the bar, and a second type having the arcuate flange 85 generally aligned with the shank of the bar. The first and second types of the actuator bars 82 and 83 are fitted into the alternate ones of the recesses 62 in such a manner that, as shown in FIG. 6, the arcuate flanges 84 of the first type are closely arranged along an outer circumferential row about the longitudinal axis of the plucking cylinder 60, while the arcuate flanges 85 of the second type are closely arranged along an inner circumferential row about the longitudinal axis. Further, the arcuate flanges 84 in the outer circumferential row are staggered circumferentially with respect to the arcuate flanges 85 of the inner circumferential row such that each arcuate flange 84 is radially overlapped with the two adjacent arcuate flanges 85 by a half circumferential length of the arcuate flange 84. It is noted that the cam roller 50 has an axial length so that it contacts simultaneously with the arcuate flanges 84 and 85 of the outer and inner circumferential rows, respectively. Thus, as the plucking cylinder 60 rotates, the movable blades 72 in two or three adjacent rows around the circumference of the plucking cylinder 60 are simultaneously closed, while the movable blades 72 in the other rows are opened. With this result, the movable blades 72 in each row are kept closed over a prolonged period as the plucking cylinder rotates for successful hair plucking, while enabling to provide a large number of the rows of the blades around the circumference of the plucking cylinder 60 of a limited diameter.

The head frame 40 carrying the plucking cylinder 60 is supported to the base 30 so as to be movable along the longitudinal axis of the plucking cylinder 60 within a plane perpendicular to the upright axis of the housing 10. For this purpose, the head frame 40 is formed on its bottom with a pair of legs 55 loosely engaged into corresponding cavities 35 in the opposite longitudinal ends of the base 30. Guide pins 36, which are fixed to the base 30, extend through guide holes 56 in the legs 55 to guide the movement of the head frame 40 along the longitudinal axis of the plucking cylinder 60 between two opposite end positions. The head frame 40 is normally urged towards a neutral position of FIG. 1 by springs 37 compressed between the legs 55 of the head frame 40 and the opposite walls of the cavities 35. Each leg 55 is formed with a catch 57 for retaining the spring 37.

Figure 8B:
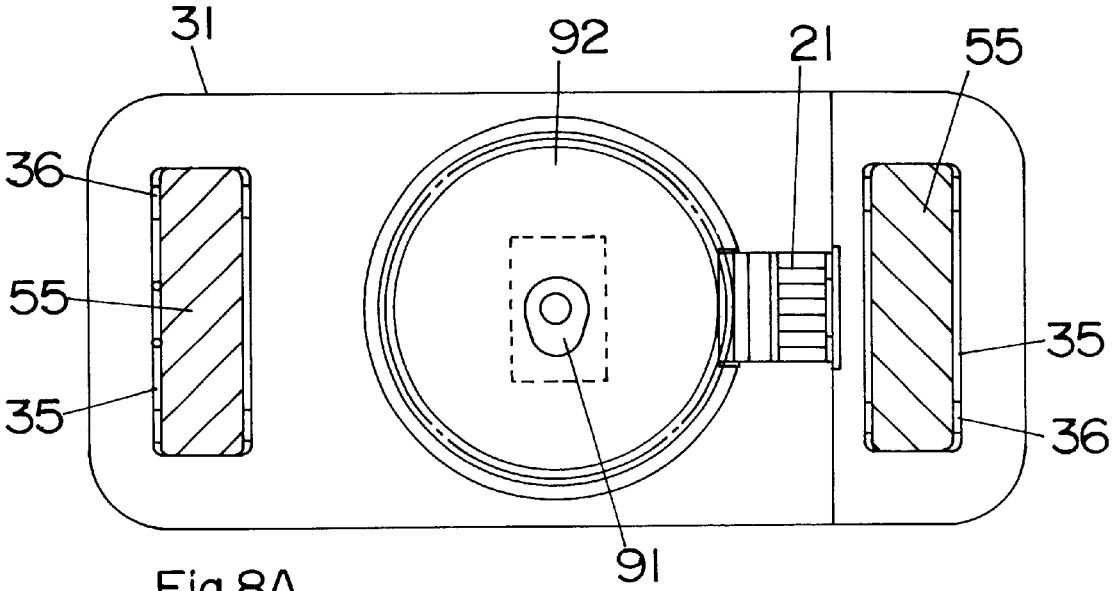
FIGS. 8A and 8B are views illustrating the plucking cylinder at its neutral position and a corresponding cross section taken along line X—X of FIG. 8A.
Figure 8A:
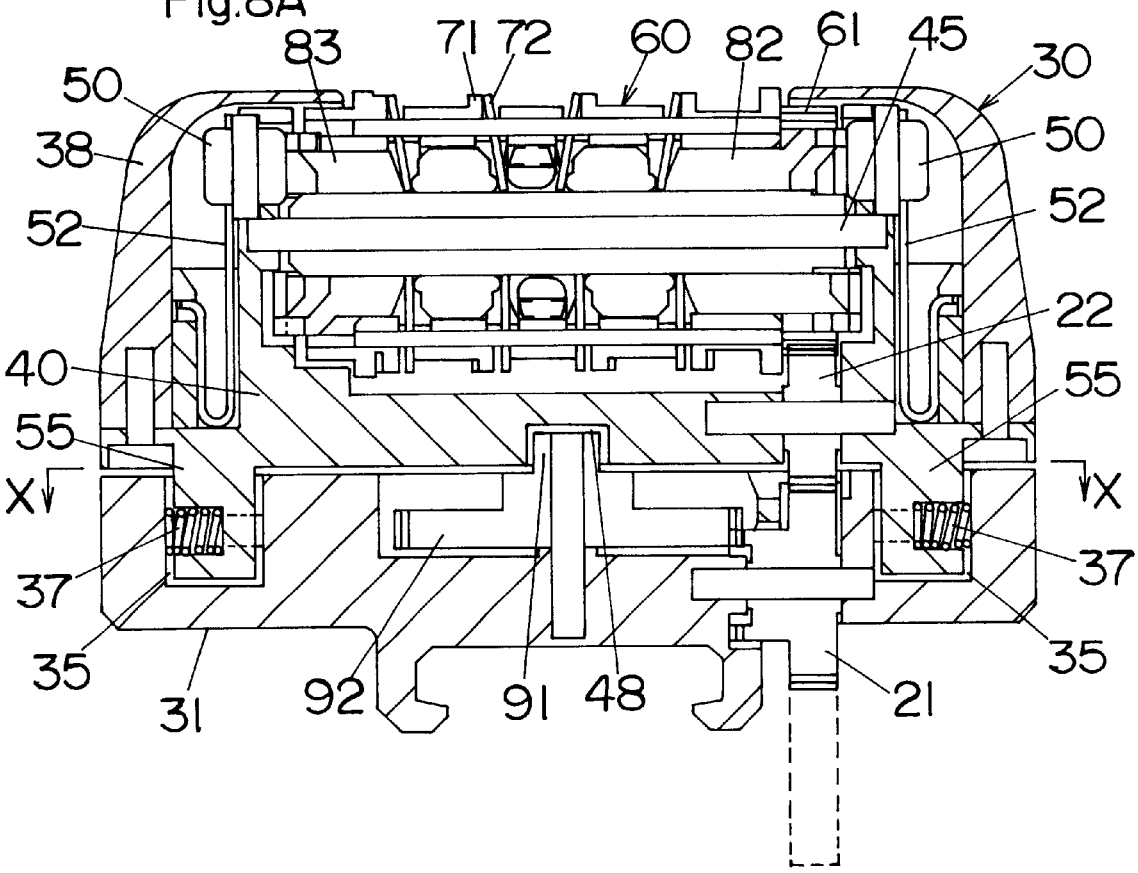
Figure 9B:
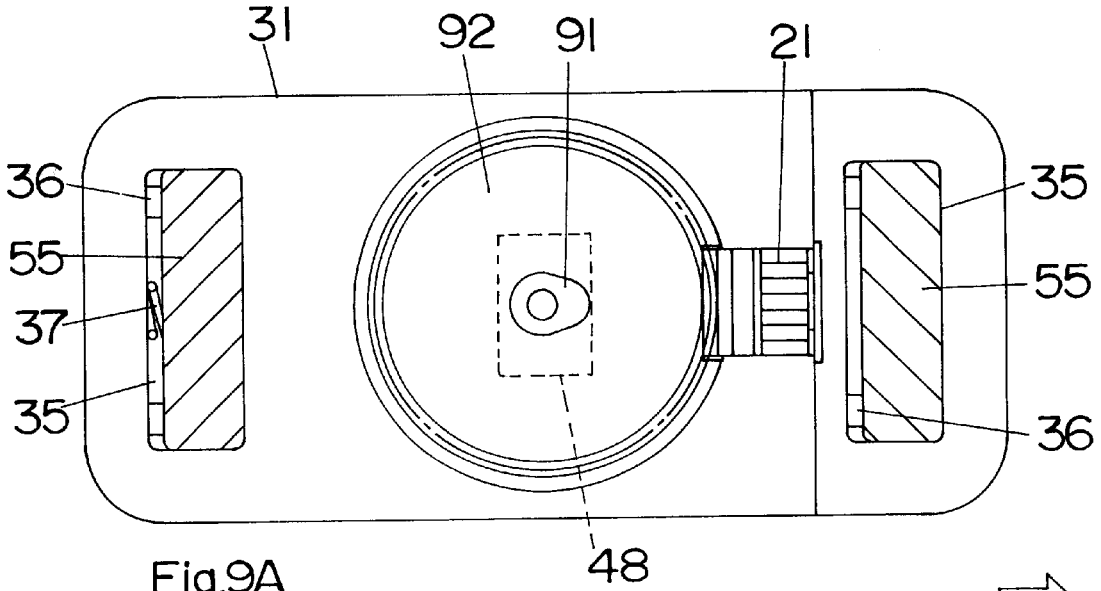
FIGS. 9A and 9B are views illustrating the plucking cylinder at its one end position and a corresponding cross section taken along line X—X of FIG. 9A.
Figure 9A:
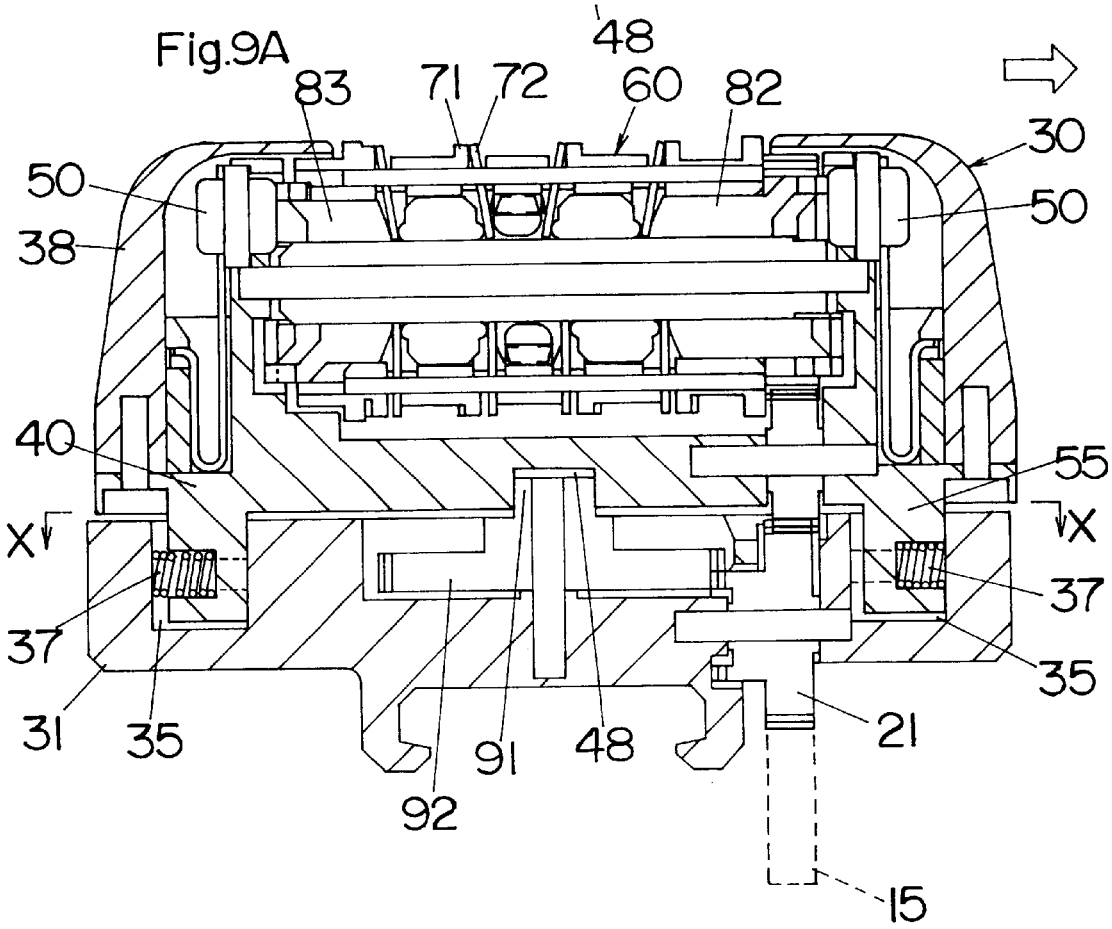
Figure 10B:
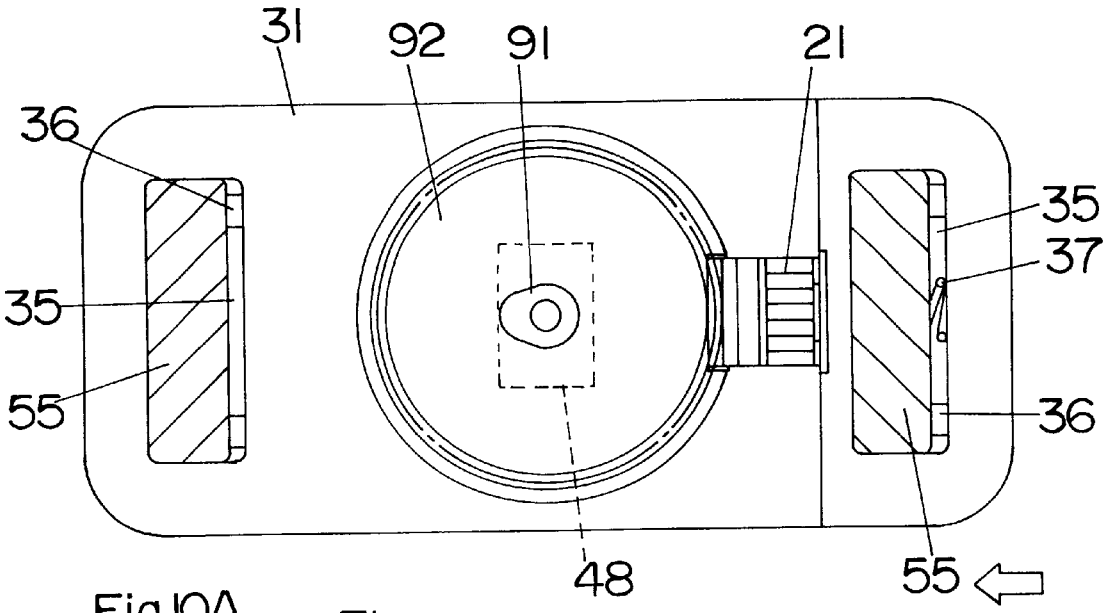
FIGS. 10A and 10B are views illustrating the plucking cylinder at the other end position and a corresponding cross section taken along line X—X of FIG. 10A.
Figure 10A:
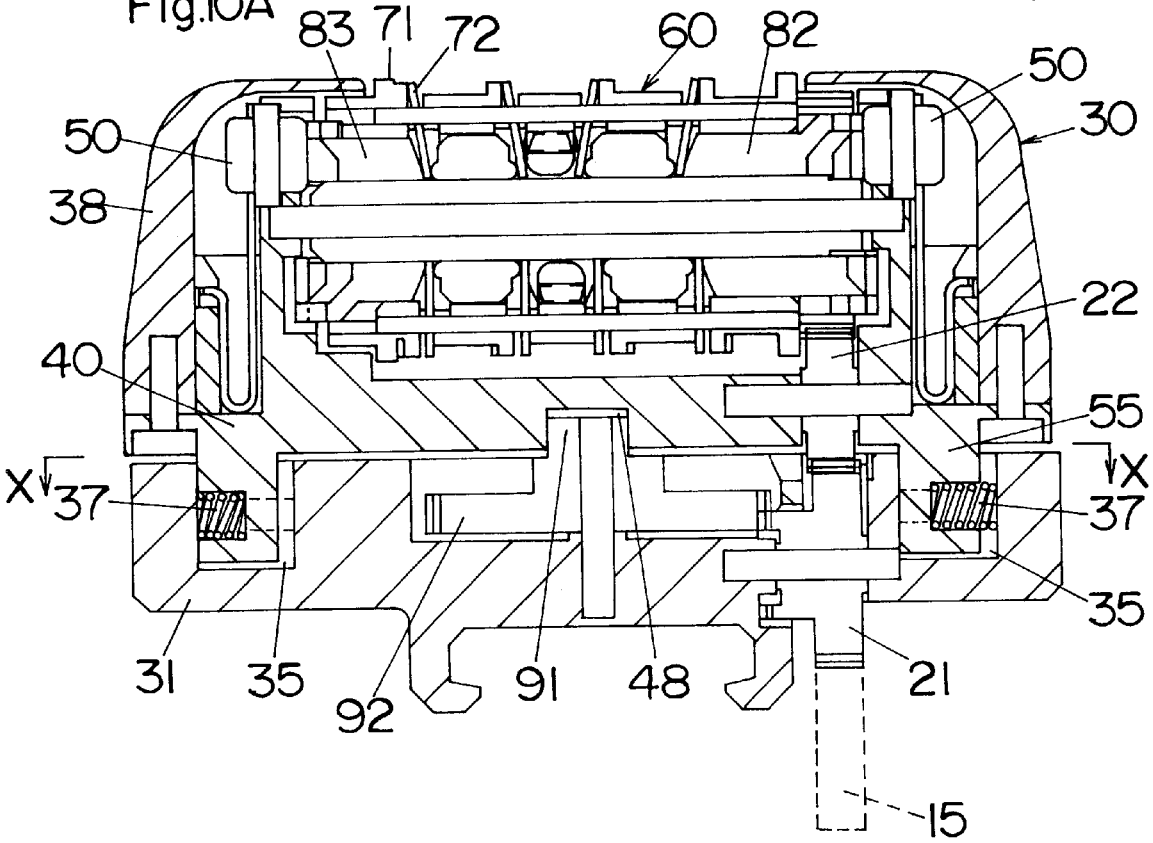
Figure 11A:
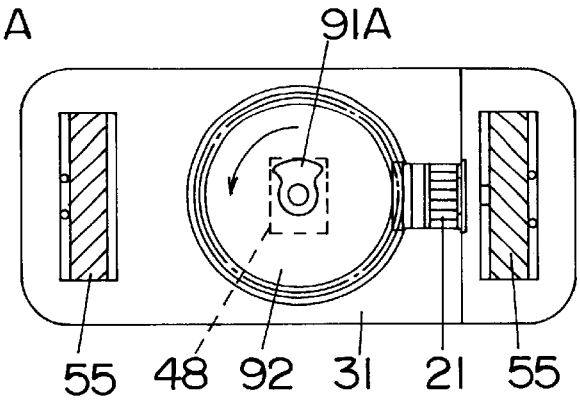
FIGS. 11A, 11B, 11C, and 11D are views respectively illustrating operations of a hand-held epilating device in accordance with a modification of the above embodiment.
Figure 11B:
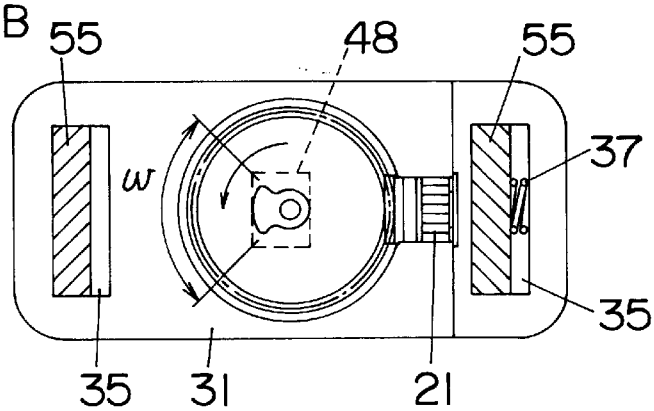
Figure 11C:
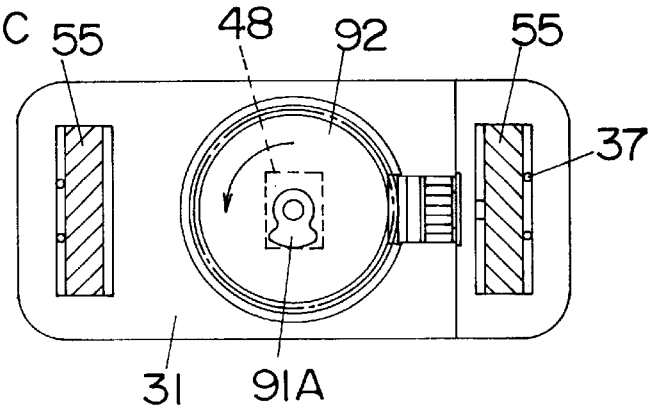
Figure 11D:
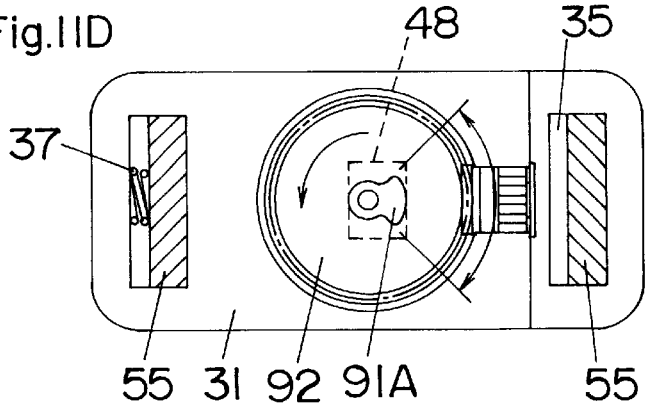
Figure 12A:
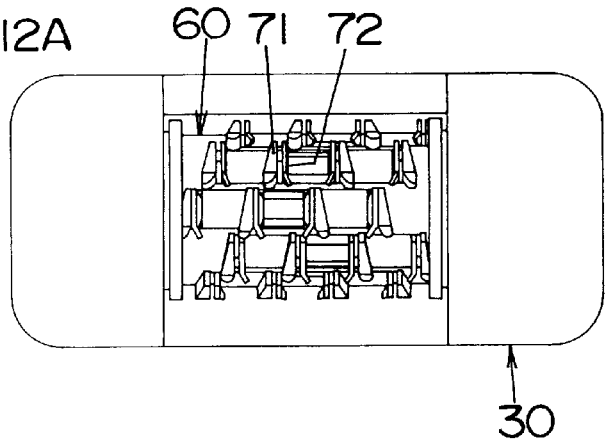
FIGS. 12A, 12B, 12C, and 12D are top views of the epilating device, respectively in correspondence to FIGS. 11A, 11B, 11C and 11D.
Figure 12B:
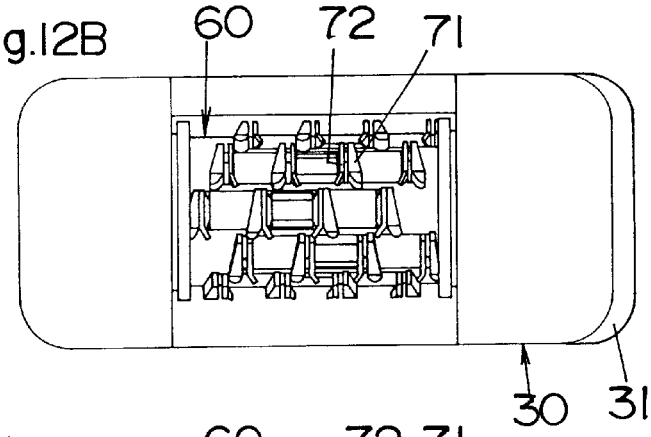
Figure 12C:
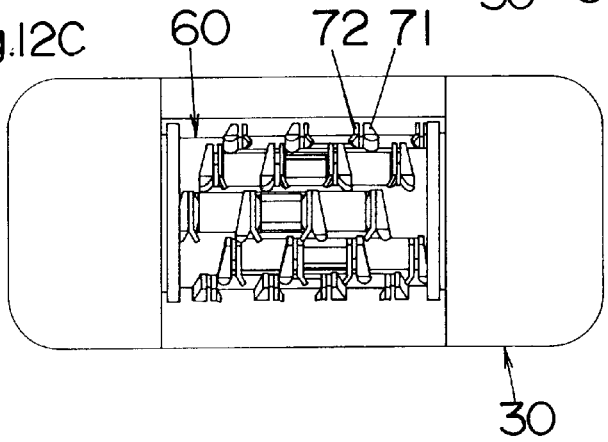
Figure 12D:
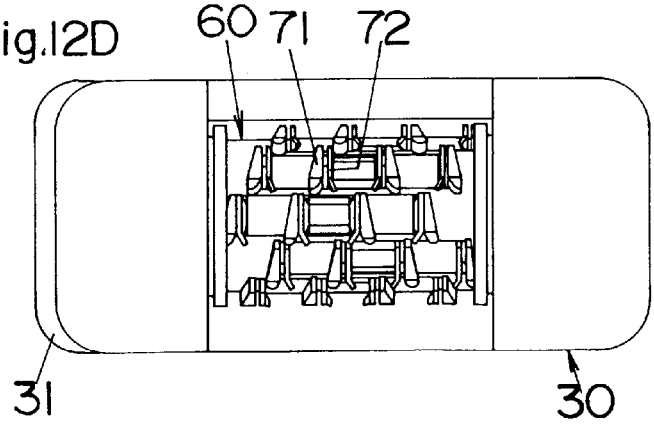

The head frame 40 movably supported to the base 30 is driven by a cam mechanism to reciprocate between the two end positions past the neutral position. The cam mechanism comprises a cam 91 which is integrally formed on a gear 92 to have a common vertical center axis. The gear 92 is meshes with the first driven gear 21 so as to rotate the cam 91 about a vertical axis while the plucking cylinder 60 is driven to rotate about the longitudinal axis. The cam 91 is engaged into a follower cavity 48 in the center bottom of the head frame 40. The follower cavity 48 is generally rectangular in shape so that the cam 91 is engageable with opposite longitudinal edges of the cavity 48 as the cam 91 rotates, thereby forcing the head frame 40 to move against the bias of the springs 37 towards the end positions. After the cam 91 is disengaged from the longitudinal edges of the cavity 48, the head frame 40 is caused to move quickly by the springs 37 to the neutral position from the end positions. Thus, the head frame 40 carrying the plucking cylinder 60 reciprocates along the longitudinal axis between the end positions of FIGS. 9A and 9B, and 10A and 10B past the neutral position of FIGS. 8A and 8B, as the plucking cylinder 60 rotates about the longitudinal axis. The plucking cylinder 60 reciprocates at a reciprocation cycle which is greater than the rotation cycle of the same. That is, the rotation speed of the cam 91 is slower than the rotation speed of the plucking cylinder 60 such that the plucking cylinder 60 rotates by an extent as to complete one epilating action of catching and pinching the hairs between the blades 71 and 72 at one or more rows of the blades while the plucking cylinder 60 or the head frame 40 supporting the same is around the end position and at the neutral position. Whereby, each set of the blades can make the hair plucking at three axially different positions for enhancing the plucking efficiency. For instance, the plucking cylinder 60 rotates two-thirds while the cam 91 abuts against each of the longitudinal edges of the cavity 48 to retain the plucking cylinder 60 around the end position, and the plucking cylinder 60 makes one rotation while the cam 91 is disengaged from the longitudinal edge of the cavity 48 to retain the plucking cylinder 60 at the neutral position. It is noted in this connection, that the plucking cylinder 60 is caused to reciprocate at an amplitude which is ⅓ to ½ of the pitch distance between the adjacent sets of the blades so that each set of the pinching blades 71 and 72 covers a wide area of the skin without causing overlapping of the areas covered respectively by adjacent sets of the blades 71 and 72. Further, the plucking cylinder 60 is driven to move between the neutral position and each of the end positions at a speed which is greater than a circumferential speed of the plucking cylinder.

Instead of the cam 91, it is advantageous to employ a modified cam 91A having an enlarged fan-shaped head as shown in FIGS. 11 and 12 which illustrate reciprocating movement of the plucking cylinder in accordance with a modification of the above embodiment. Like parts are designated by like numerals for simplicity. With the use of thus configured cam 91A, the plucking cylinder 60 stops moving along the longitudinal axis and is standstill at each of the end positions while the cam 91A rotates over a wide angular range ω as shown in FIGS. 11B and 11D. At both of the end positions, the plucking cylinder 60 is driven to rotate continuously by such an extent as to complete one epilating action of catching and pinching the hairs between the blades 71 and 72 at one or more rows of the blades. Also, while the cam 91A disengages from the longitudinal edges of the follower cavity 48, the plucking cylinder 60 are kept at the neutral position, as shown in FIGS. 11A and 11C, and 12A and 12C, in which the plucking cylinder 60 is driven to rotate continuously by such an extent as to complete one epilating action of catching and pinching the hairs between the blades 71 and 72 at one or more rows of the blades. For instance, the plucking cylinder 60 makes one complete rotation when it is held in the end position and the neutral position. In other words, the reciprocation cycle of the plucking cylinder is made greater than the rotation cycle of the same. Therefore, also in this modification, each set of the blades can make the hair plucking at the three different axial positions for effectively plucking the hairs covered by the length of the plucking cylinder 60. It is noted in this connection that the plucking cylinder 60 returns to the neutral position quickly as soon as the cam 91A disengages from the longitudinal edge of the follower cavity 48. That is, the plucking cylinder moves between these positions faster than the circumferential speed of the plucking cylinder 60. Therefore, the hair plucking is less expected when the plucking cylinder is moving between the end positions to the neutral position. If the hair plucking be made in this transition period, the hairs would be pulled in a direction other than the circumferential direction and might fail to be smoothly plucked. Also in this modification, the plucking cylinder 60 is caused to reciprocate at an amplitude which is ⅓ to ½ of the pitch distance between the adjacent sets of the blades so that each set of the blades 71 and 72 covers a wide area of the skin without causing overlapping of the areas covered respectively by adjacent sets of the blades 71 and 72.

Figure 13:
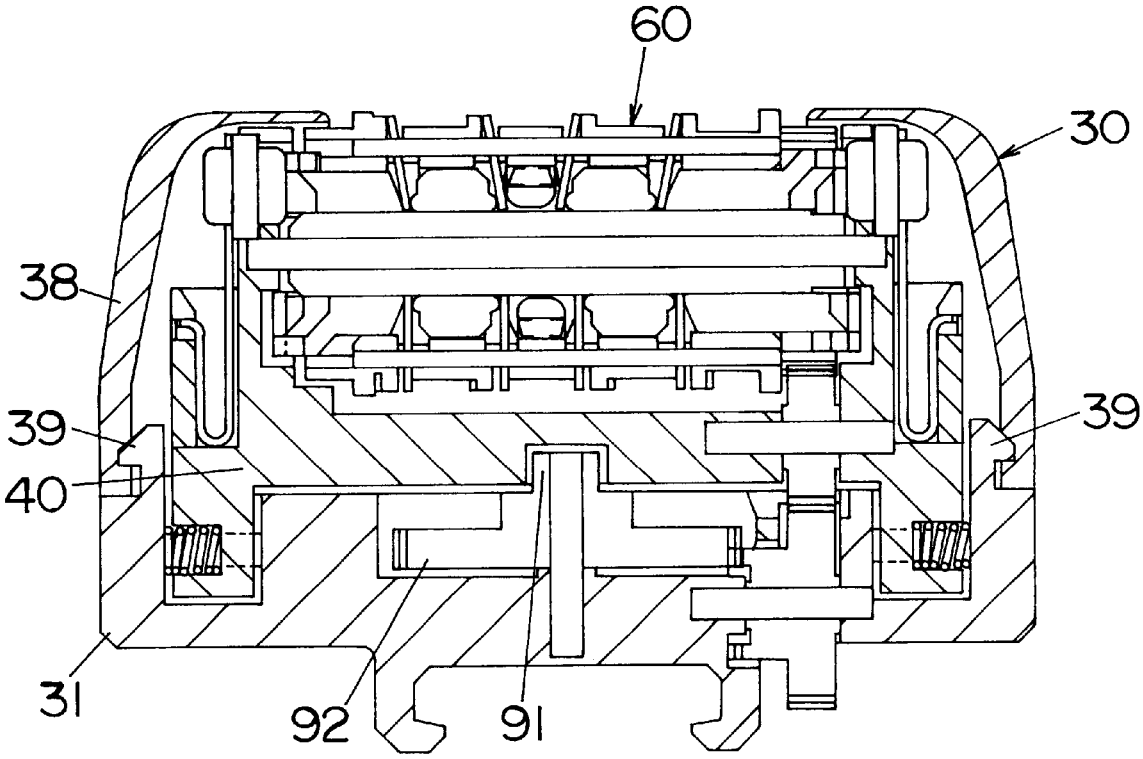
FIG. 13 is a vertical section of a principal portion of a hand-held epilating device in accordance with another modification of the embodiment.

FIG. 13 illustrates another modification of the above embodiment which is identical to the embodiment except that the head cover 38 is secured to the base 31 of the epilator head 30 by means of hooks 39 rather than to the head frame 40 so that the head cover 38 is kept stationary while the plucking cylinder 60 reciprocates. Thus, the head cover 38 does not act to rub the skin of the user due to the reciprocal movement of the plucking cylinder. Like parts are designated by like numerals.

Figure 14:
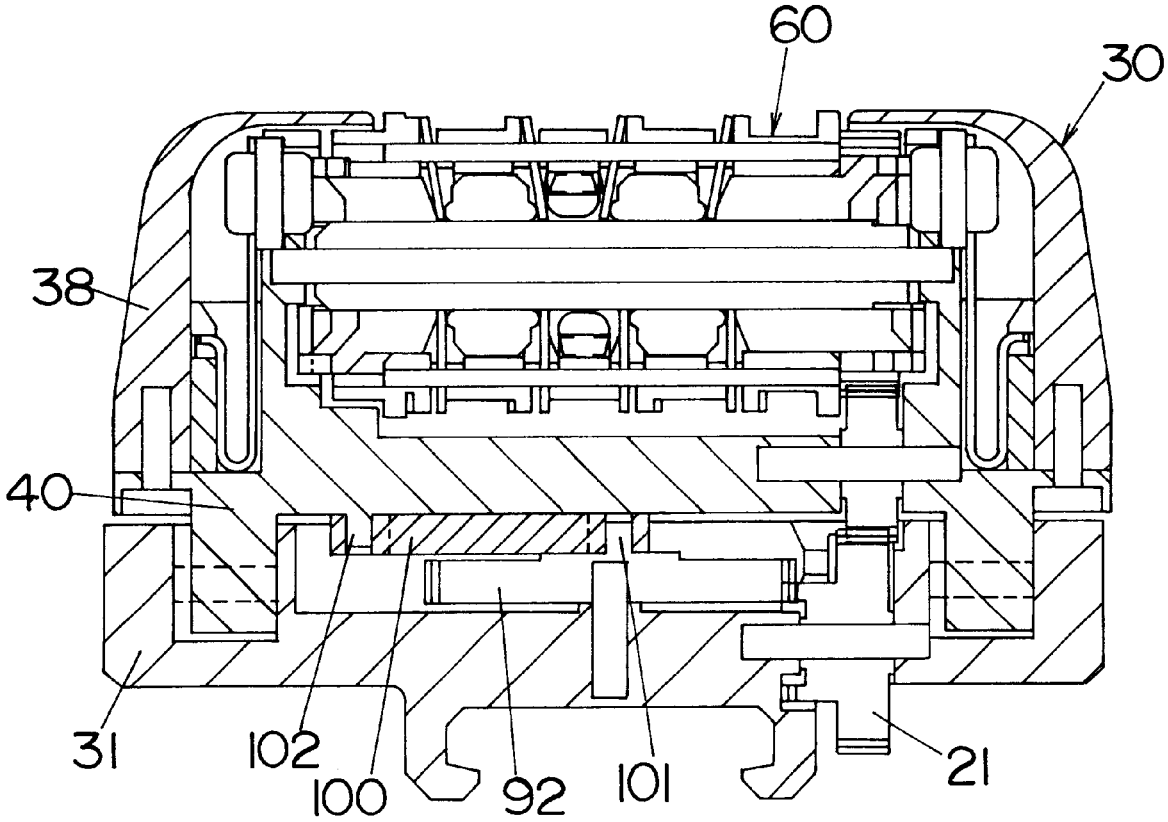
FIG. 14 is a vertical section of a principal portion of a hand-held epilating device in accordance with a further modification of the embodiment.
Figure 15:
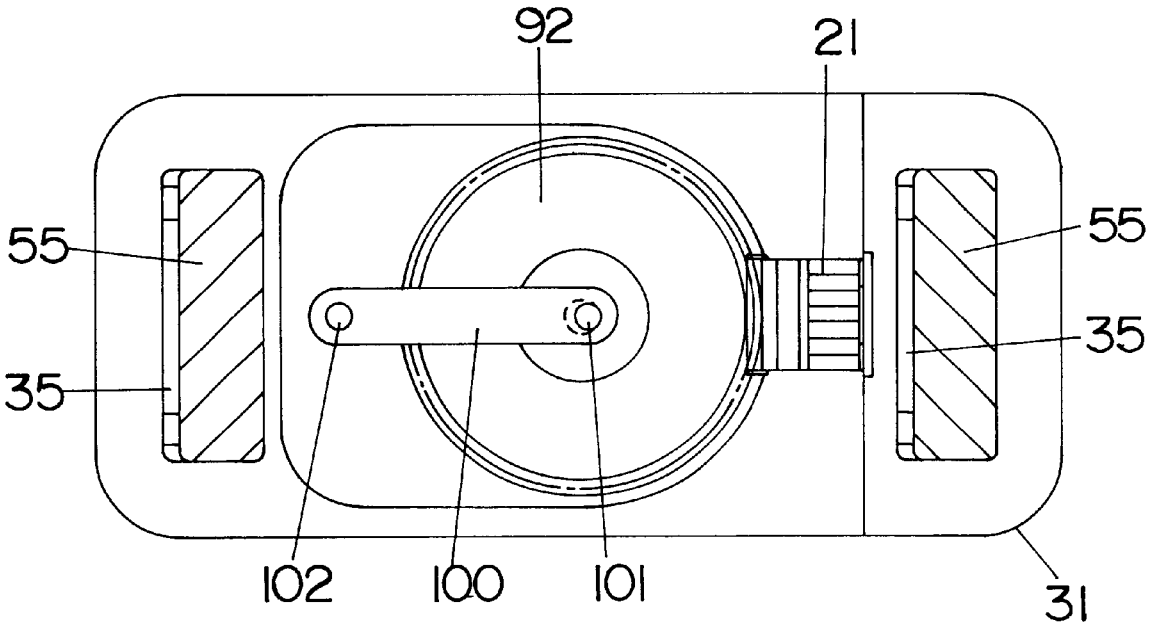
FIG. 15 is a cross section taken along line X—X of FIG. 13.

FIGS. 14 and 15 illustrate a further modification of the above embodiment which is identical to the embodiment except that a crank mechanism is employed instead of the cam mechanism. The crank mechanism comprises a crank lever 100 linking an eccentric pin 101 on the gear and a crank pin 102 on the bottom of the head frame 40 so as to translate the rotational movement of the gear into the reciprocal movement of the head frame 40 carrying the plucking cylinder 60.

Figure 16:
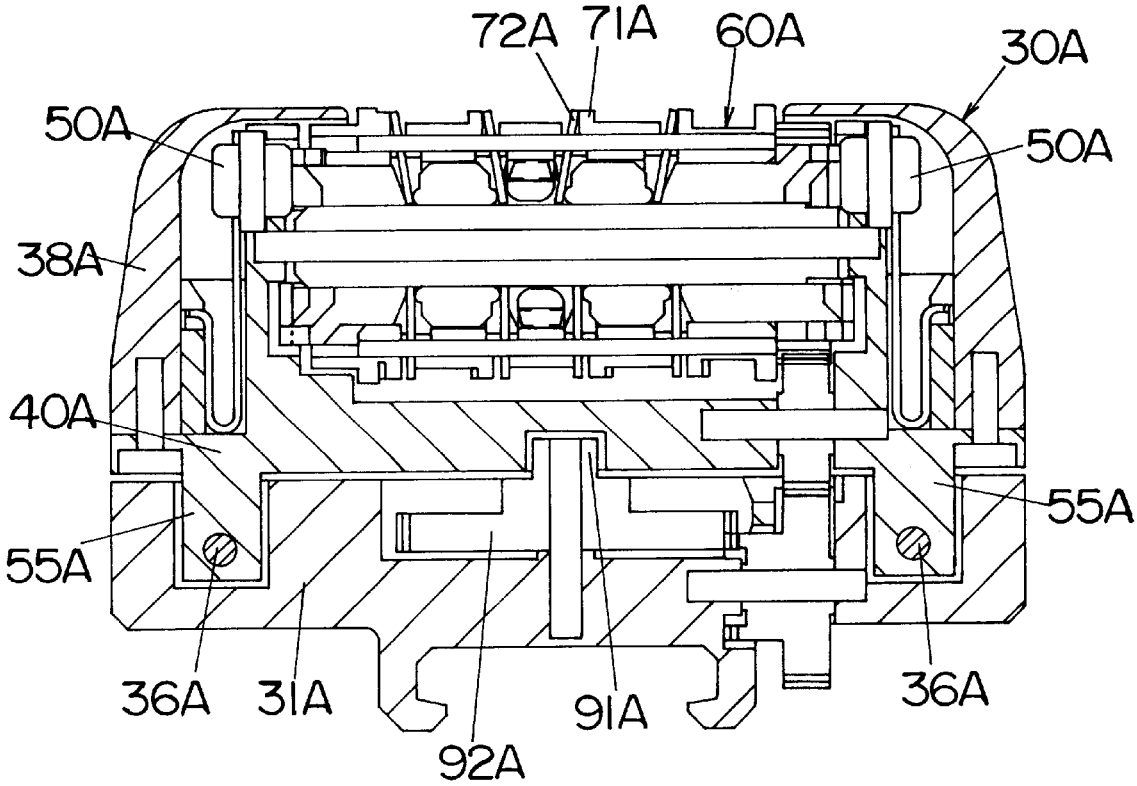
FIG. 16 is a vertical section of a principal portion of a hand-held epilating device in accordance with a still further modification of the embodiment.
Figure 17:
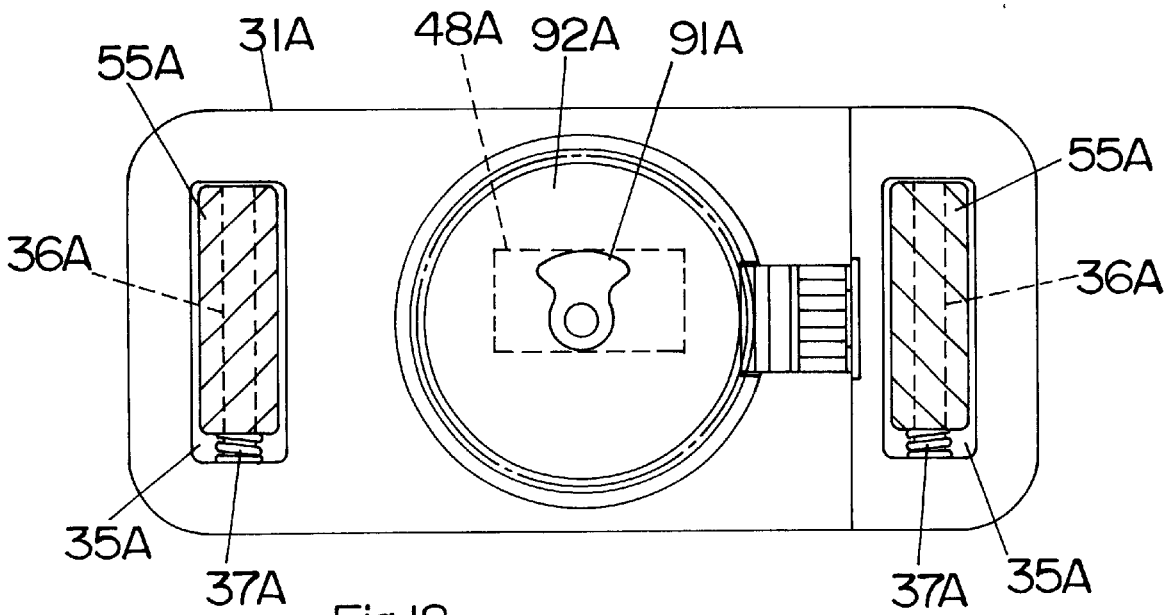
FIGS. 17 and 18 are views illustrating an operation of the epilating device of FIG. 16.
Figure 18:
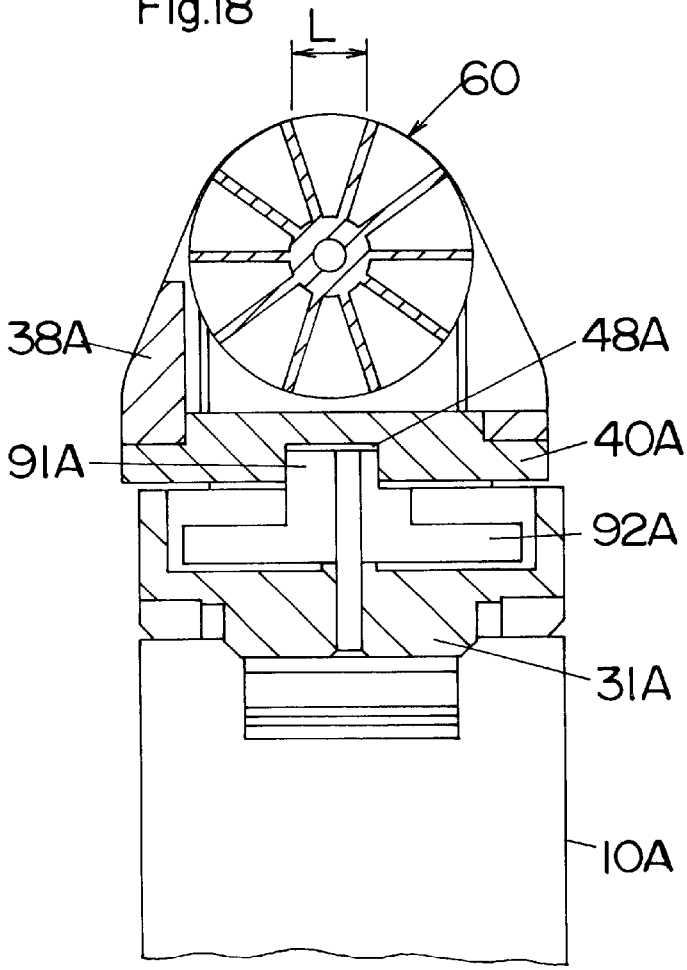

FIGS. 16 to 18 illustrate a second embodiment of the present invention which is similar to the first embodiment except that a like head frame 40A carrying a like plucking cylinder 60A is driven to move in a transverse direction perpendicular to the longitudinal axis of the plucking cylinder as well as a vertical axis of a like housing 10A, relative to a base 31A of the epilator head 30A. Like parts are designated by like numerals with a suffix letter of "A" for easy reference purpose. Legs 55A of the head frame 40A are loosely engaged respectively into cavities 35A of the base 31A, as shown in FIGS. 16 and 17, and are supported to guide pins 36A to be movable in the transverse direction. Springs 37A are also employed to urge the head frame 40A towards the neutral position from the end positions of the head frame. The head frame 40A is driven to reciprocated along the transverse direction by a like cam mechanism comprising a cam 91A on the gear 92A and a follower cavity 48A in the bottom of the head frame 40A. Also in this embodiment, the plucking cylinder 60A temporarily stops in its transverse movement both at the end positions and the neutral position for a certain interval within which the plucking cylinder 60A rotates by a certain angle sufficient for completing the hair plucking. For this purpose, the reciprocation cycle of the plucking cylinder is made greater than the rotation cycle of the same. Thus, the effective length of the pinching blades 71A and 72A along the circumferential direction can be elongated to increase the chances of catching the plucking the hairs lying on the skin along the transverse direction of the plucking cylinder 60A. Also in this embodiment, the plucking cylinder 60A returns quickly to the neutral position from the end positions such that the hair plucking is less expected in the transition period of the plucking cylinder moving between the end positions and the neutral positions. That is, the plucking cylinder moves between these positions faster than the circumferential speed of the plucking cylinder.

Figure 19:
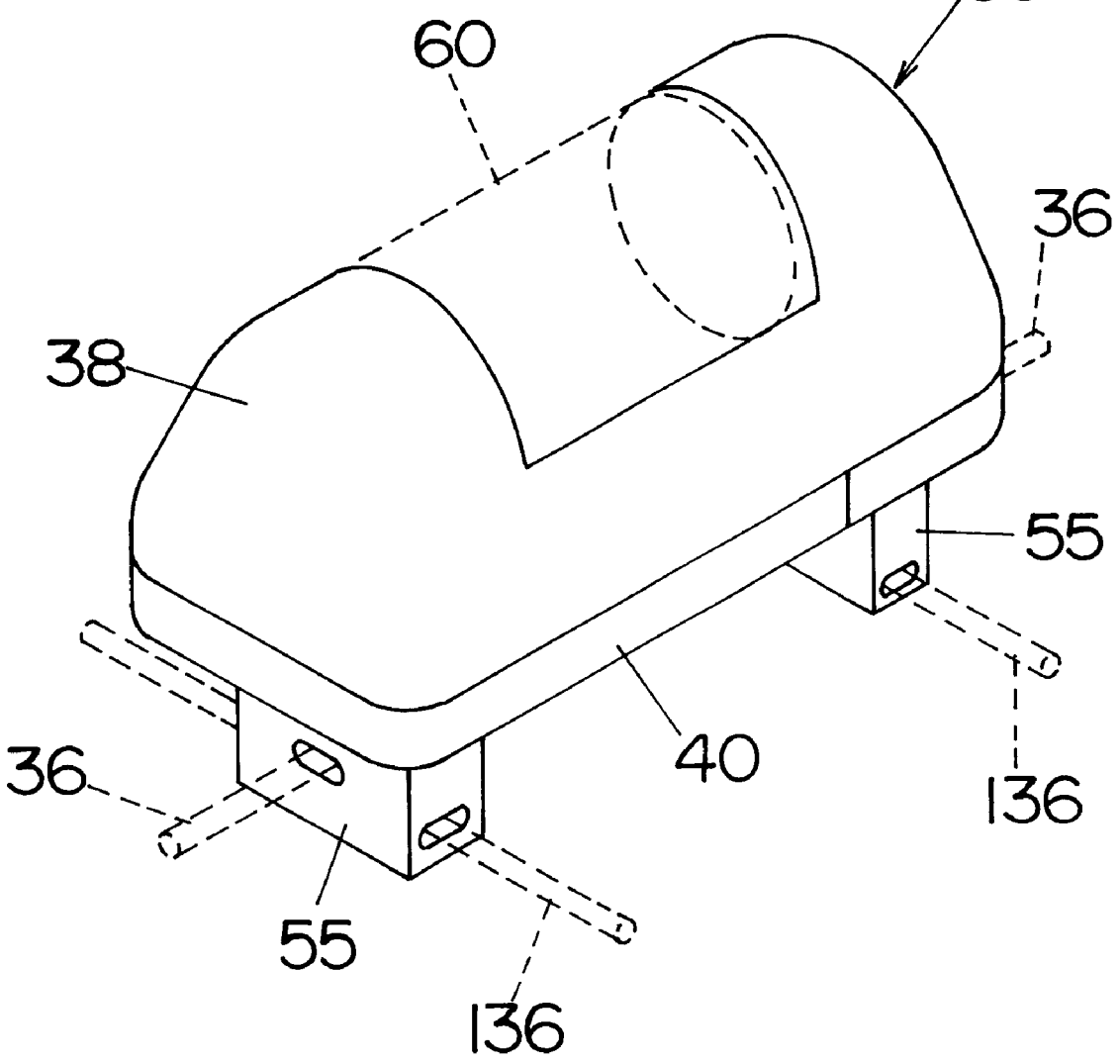
FIG. 19 is a schematic view illustrating an epilator head utilized in a hand-held epilating device in accordance with a further modification of the embodiment.

FIG. 19 illustrates a modification of the above embodiments which is similar to the above embodiments except that the head frame 40 carrying the plucking cylinder 60 is supported to reciprocate both along the longitudinal axis of the plucking cylinder and along the transverse direction. For this purpose, the head frame 40 has its legs 55 loosely engaged into cavities in a like base, and are guided along longitudinal guide pins 36 as well as transverse guide pins 136 extending through the corresponding holes in the legs 55. A like cam mechanism is employed to give a translational movement to the head frame 40 so that the plucking cylinder 60 can reciprocate both along the longitudinal and transverse directions as the plucking cylinder rotates about the longitudinal axis.

What is claimed is:

1. A hand-held epilating device comprising:

a housing to be grasped by a hand of a user;

plucking cylinder mounted on top of said housing and carrying at least one set of pinching elements for catching and pinching body hairs therebetween;

said plucking cylinder having a longitudinal axis and being driven to rotate about said longitudinal axis to pluck the body hairs from the user's skin, wherein said plucking cylinder is supported to said housing so as to effect a periodical movement relative to said housing within a plane parallel to said longitudinal axis.

2. The hand-held epilating device as set forth in claim 1, wherein said plucking cylinder reciprocates relative to said housing along the longitudinal axis.

3. The hand-held epilating device as set forth in claim 2, wherein said plucking cylinder reciprocates relative to said housing between two end positions and is held temporarily at each of said end positions for a short time interval during which said plucking cylinder rotates to such an extent of completing one epilating action of catching the body hairs between the pinching elements and plucking the body hairs.

4. The hand-held epilating device as set forth in claim 3, wherein said plucking cylinder has a neutral position between said two end positions and is held temporarily at said neutral position for a short time during which said plucking cylinder rotates about said longitudinal axis to such an extent of completing one epilating action of catching the body hairs between the pinching elements and plucking the body hairs.

5. The hand-held epilating device as set forth in claim 2, wherein said plucking cylinder is provided with at least two sets of said pinching elements which are spaced along said longitudinal axis at a pitch distance between the adjacent set of said pinching elements, said plucking cylinder reciprocating at an amplitude which is ⅓ to ½ of said pitch distance.

6. The hand-held epilating device as set forth in claim 4, wherein said plucking cylinder moves between said neutral position and each of said end positions at a speed which is greater than a circumferential speed of said plucking cylinder.

7. The hand-held epilating device as set forth in claim 4, wherein said plucking cylinder is spring-biased towards said neutral position.

8. The hand-held epilating device as set forth in claim 2, wherein said plucking cylinder reciprocates at a reciprocation cycle which is greater than a rotating cycle at which said plucking cylinder completes one rotation about the longitudinal axis.

9. The hand-held epilating device as set forth in claim 7, wherein said reciprocation cycle is at least twice of said rotation cycle.

10. The hand-held epilating device as set forth in claim 1, wherein said plucking cylinder is provided with more than one set of said pinching elements spaced circumferentially about said longitudinal axis.

11. The hand-held epilating device as set forth in claim 1, wherein a head cover is mounted on said housing, said head cover having a top opening through which said pinching elements are exposed for catching the body hairs, said head cover being fixed to said housing so that said plucking cylinder makes the periodical movement relative to said head cover.

12. The hand-held epilating device as set forth in claim 1, wherein said housing is provided with a head cover having a top opening through which said pinching elements are exposed for catching the body hairs, said head cover being movably supported to said housing and is coupled to said plucking cylinder so that said head cover makes the periodical movement together with said plucking cylinder.

13. The hand-held epilating device as set forth in claim 1, wherein said plucking cylinder reciprocates along a direction which is perpendicular to said longitudinal axis as well as to an upright axis of said housing.

14. The hand-held epilating device as set forth in claim 13, wherein the pinching elements are arranged along the longitudinal axis of said plucking cylinder and have a length along a circumference of said plucking cylinder, said plucking cylinder reciprocating at an amplitude which is substantially equal to said length of said pinching element.

15. The hand-held epilating device as set forth in claim 13, wherein said plucking cylinder reciprocates between opposite end positions and is held temporarily at each of said opposite end positions for a short time interval during which said plucking cylinder rotates to such an extent of completing one epilating action of catching the body hairs between the pinching elements and plucking the body hairs.

16. The hand-held epilating device as set forth in claim 15, wherein said plucking cylinder has a neutral position between said opposite end positions and is held temporarily at said neutral position for a short time interval during which said plucking cylinder rotates to such an extent of completing one epilating action of catching the body hairs between the pinching elements and plucking the body hairs, said plucking cylinder moves between said neutral position and the end positions at a speed greater than the circumferential speed of said plucking cylinder.

17. The hand-held epilating device as set forth in claim 13, wherein said plucking cylinder reciprocates at a reciprocation cycle which is greater than a rotating cycle at which said plucking cylinder completes one rotation about the longitudinal axis.

18. The hand-held epilating device as set forth in claim 17, wherein said reciprocation cycle is at least twice of said rotation cycle.

19. The hand-held epilating device as set forth in claim 1, wherein said plucking cylinder reciprocates along the longitudinal axis as well as along a direction perpendicular to the longitudinal axis to effect a translational movement relative to said housing.

20. The hand-held epilating device as set forth in claim 1, wherein said plucking cylinder carries plural sets of the pinching elements spaced circumferentially about the longitudinal axis, each set of the pinching elements includes a movable element which is driven to move along the longitudinal axis for pinching the body hairs between said pinching elements, said plucking cylinder carrying a plurality of actuator bars extending parallel to said longitudinal axis and arranged circumferentially about said longitudinal axis, each said actuator bar having a first end engaged with said movable element for driving said movable element and having a second end projecting on one end face of said plucking cylinder to be engageable with a cam disposed to oppose said end face, said cam being positioned to be in selective contact with the second ends of said actuator bars in such a manner as to move the actuator bars in a direction of pinching the body hairs between said pinching elements as said plucking cylinder rotates about the longitudinal axis, said second end of each actuator bar being shaped to extend circumferentially about the longitudinal axis on said end face of said plucking cylinder to give an arcuate flange, said arcuate flanges of the circumferentially adjacent actuator bars being partially overlapped with each other in a radial direction such that the overlapped portions of said arcuate flanges come simultaneously into contact with said cam.

21. The hand-held epilating device as set forth in claim 20, wherein said arcuate flanges of the actuator bars are arranged in two circumferential rows extending about said longitudinal axis, one being an outer circumferential row and the other being an inner circumferential row, said arcuate flanges of said outer circumferential row being staggered circumferentially with respect to the arcuate flanges of said inner circumferential row.

22. The hand-held epilating device as set forth in claim 21, wherein each arcuate flange of said outer circumferential row is overlapped with the two adjacent arcuate flanges of said inner circumferential row over about one-half circumferential length of the arcuate flange of said outer circumferential row.

* * * * *